US005617125A

United States Patent [19]

Chew

[11] Patent Number: 5,617,125

[45] Date of Patent: Apr. 1, 1997

[54] SPITTOON SYSTEM FOR INK-JET PRINTERS

[75] Inventor: Chee C. Chew, Singapore, Singapore

[73] Assignee: Hewlett-Packard Company, Palo Alto, Calif.

[21] Appl. No.: 214,712

[22] Filed: Mar. 15, 1994

[51] Int. Cl.[6] ..... B41J 2/165

[52] U.S. Cl. ..... 347/36; 347/31; 347/35

[58] Field of Search ..... 347/22, 29, 31, 347/36, 35, 34

[56] References Cited

U.S. PATENT DOCUMENTS

| | | | |
|---|---|---|---|
| 4,024,548 | 5/1977 | Alonso et al. | 347/34 |
| 4,628,331 | 12/1986 | Ishikawa | 347/34 |
| 4,682,184 | 7/1987 | Terasawa | 347/30 |
| 4,794,409 | 12/1988 | Cowger et al. | 347/87 |
| 4,885,932 | 12/1989 | Hefferman et al. | 73/53 |
| 5,121,132 | 6/1992 | Pan et al. | 347/87 |

FOREIGN PATENT DOCUMENTS

| | | | |
|---|---|---|---|
| 4-90361 | 3/1994 | Japan | 347/31 |

OTHER PUBLICATIONS

Hewlett–Packard User's Guide, HP DeskJet 310 Printer, 1993.

*Primary Examiner*—John E. Barlow, Jr.

[57] ABSTRACT

A spittoon system is described as an assemblage of sorbent pads that leads away from a region beneath an ink-jet printer's printhead when the latter is in its service position, with the pads' material and structure defining plural contact interface regions between successive pads, the interface regions having a plurality of hardness and sorbency characteristics. Preferably, the system includes a first sorbent pad that is spring biased into contact with a second sorbent pad. The second pad matingly engages a third pad preferably having a compatible sorbency with the second pad, but having a different hardness such that one yields to the other and the surface area of their mating expanses is maximized. Preferably, the third foam pad itself is an assemblage of two pad sections having different thicknesses, the two sections having mating fingers to produce a rabbet joint that holds them tightly in contact but permits easy assembly.

13 Claims, 2 Drawing Sheets

SPITTOON SYSTEM FOR INK-JET PRINTERS

TECHNICAL FIELD

The present invention relates generally to spittoons for ink-jet printers. More particularly, it concerns a high-capacity spittoon system for color portable ink-jet printers that provides unprecedented lifetime capacity in cleanly and safely containing a volume of ink discharged, or spitted, from an ink-jet printhead to clean the printhead's nozzles.

BACKGROUND ART

Previously, ink-jet printers have used spittoons into which the printhead is made to discharge, or spit, ink whether routinely to prevent crest from forming in and around its nozzles or on demand to recover from failure caused by the formation of soft ink plugs. Such spitting typically is controlled by firmware executing within the printer's controller, and is achieved very simply by moving the carriage mounting the printhead to a service station area including a spittoon and then firing one or more ink jet nozzles. Previous spittoons have been of limited capacity to absorb and contain ink, due to the limited lifetime spitting requirements of monochrome (e.g. black) ink-jet printheads. Overall printer size, including footprint and volume, typically is relatively small and imposes restrictions upon the design of spittoons having larger capacities. Thus, size limitations are an impediment to the development of higher-capacity spittoons for the newer portable color ink-jet printers.

DISCLOSURE OF THE INVENTION

The invented system addresses the difficult tradeoff between increasing spittoon capacity while maintaining or reducing printer size. It does so by low-cost means compatible with the existing "installed" base of portable monochrome ink-jet printers. The system includes plural absorbent pads configured for drawing ink spitted into a first through a second that acts as a conduit into a third, which may comprise two joined sections. Over an entire lifetime of the printer, wherein as much as 15–20 centimeters$^3$ (cm$^3$) of ink may be spitted by the printhead, nevertheless ink is contained without leakage. The invented spittoon system may be understood to be an assemblage of sorbent pads that leads away from a region beneath the printhead when the latter is in its service position, with the pads' material and structure defining plural contact interface regions between successive pads, the interface regions having a plurality of hardness and sorbency characteristics.

Another way of understanding the invented system is to see it as including a first sorbent pad that is spring biased into contact with a second sorbent pad. The second pad matingly engages a third pad preferably having a compatible sorbency with the second pad, but having a different hardness such that one yields to the other and the surface are of their mating expanses is maximized. Preferably, the third foam pad itself is an assemblage of two pad sections having different thicknesses, the two sections having mating fingers to produce a rabbet joint that holds them tightly in contact but permits their easy assembly.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
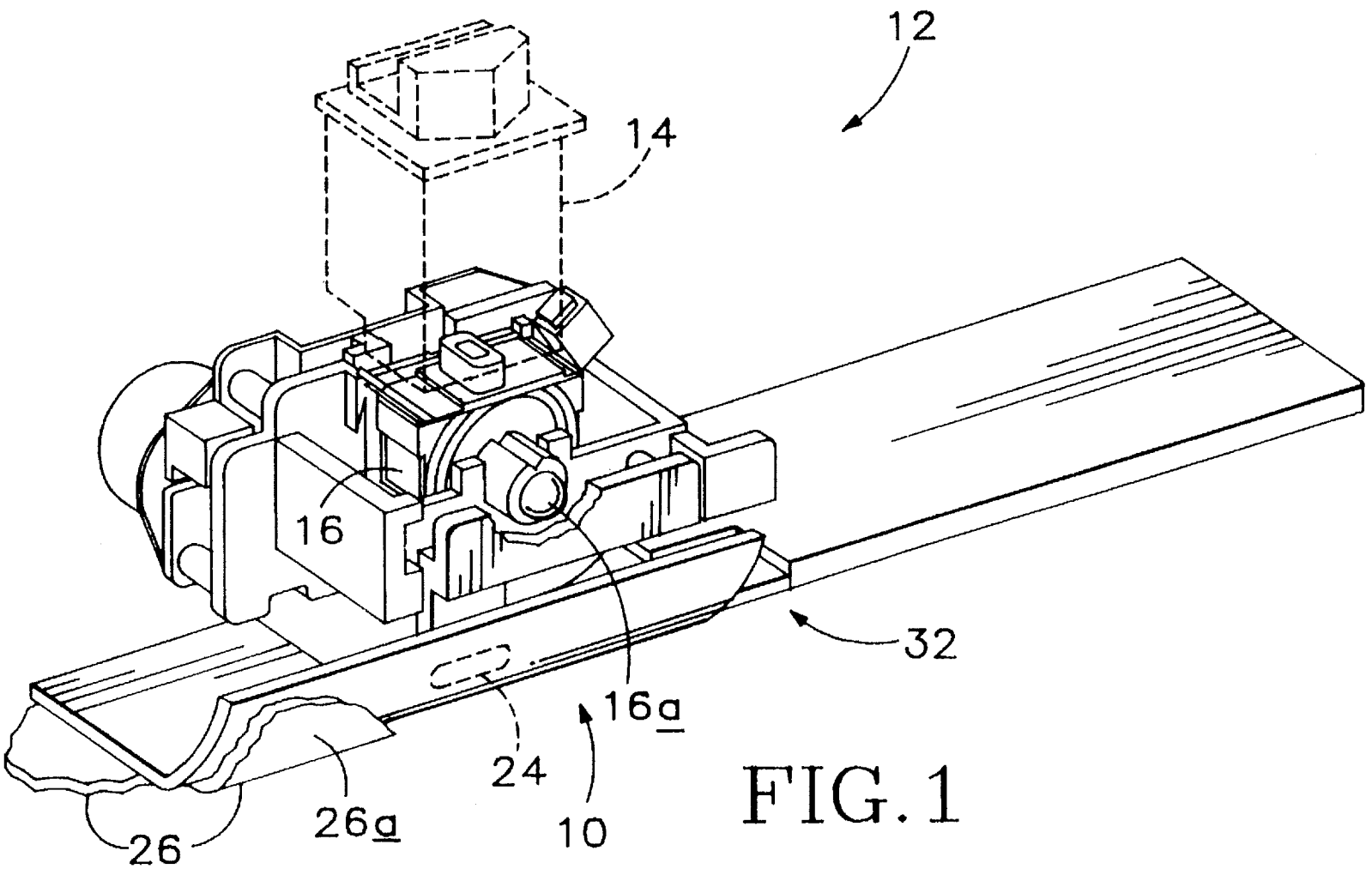
FIG. 1 is an isometric view of the invented system, made in accordance with its preferred embodiment, used in conjunction with an ink-jet printer.
Figure 2:
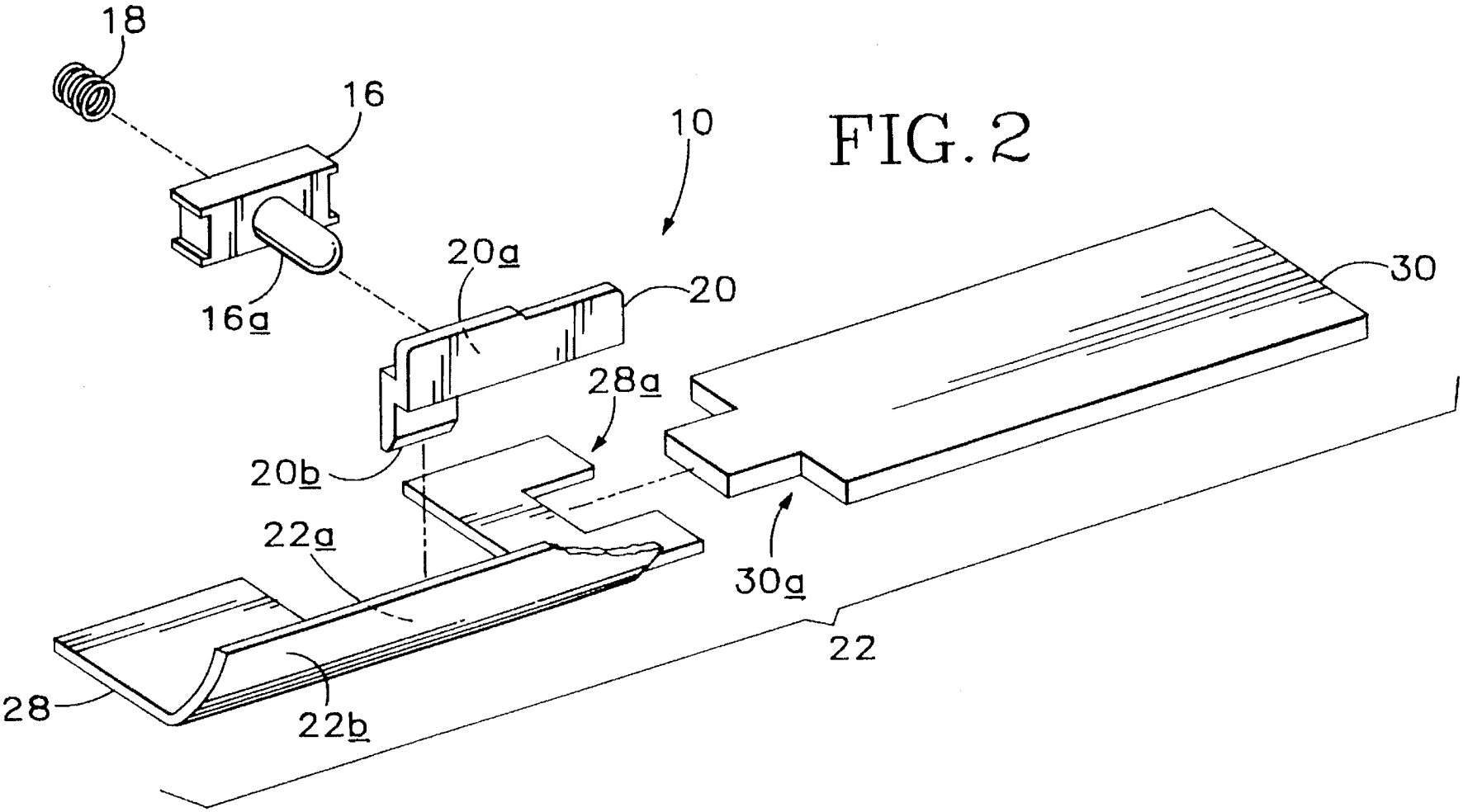
FIG. 2 is an exploded assembly drawings of the component parts of the invented spittoon system.

Referring collectively to FIGS. 1 and 2, the invented spittoon system made in accordance with its preferred embodiment is indicated generally at 10. The location of system 10 within a color portable ink-jet printer 12 is illustrated, with printer 12 shown only in pertinent part. Those skilled in the art will appreciate the usefulness of system 10 in other applications requiring a relatively large-capacity spittoon for containment of wet ink ejected or expelled for whatever reason from a reservoir such as printhead 14 shown in dashed lines. Accordingly, system 10 is described herein for use in an ink-jet printer as being a high-capacity ink-containment system for absorbing ink spitted thereat from the printer's printhead.

It may be seen from FIG. 1 that the illustrated service station takes the known form of what will be referred to herein as a tumbler by which various printhead servicing operations may be performed. FIG. 1 shows this tumbler having arcuately spaced caps, wipers and spittoons in a capping position, although those of ordinary skill will appreciate that a servo motor (not shown) serves to controllably rotate the tumbler into various predefined rotational orientations, thereby to provide the required servicing, whether capping, wiping and spitting. The structure of the service station itself, and its cooperation with the ink-jet's printhead, may of course assume alternative forms in which the invented lifetime capacity spittoon system may find utility. It will be appreciated that use of the invented spittoon, as described below, would rely on rotation of the tumbler 90° in either direction from the position shown in FIG. 1.

Invented system 10 may be seen preferably to include at least a first sorbent pad 16 located adjacent printhead 14 for receiving and at least partly containing ink spitted thereat from printhead 14, with first pad 16 including a generally cylindrical protrusion **16*a* extending in a first lateral direction, as indicated. System 10 may be seen preferably also to include a biasing member, e.g. a coil spring, 18 operatively connected with first pad 16 for urging pad 16 in the same first direction. System 10 also preferably includes a second sorbent pad 20 laterally adjacent first pad 16, with second pad 20 having an upper region 20*a* in contact with protrusion 16*a* of first pad 16, with such contact being maintained by biasing member 18. In accordance with a preferred embodiment of the invention, the volume of first pad 16 is approximately 2.0 cm$^3$ and that of second pad 20** is approximately 1.8 cm$^3$.

Preferably, first and second pads 16, 20 are formed of materials that are sorbently compatible, such that there is wicking action therebetween. In accordance with a preferred embodiment of the invention, pads 16, 20 are of a compressed foam polyurethane material and are formed by a curing forming process. By that process, a dry powder is poured into a mold cavity that is then sealed and heated to a predefined temperature at which the powder fuses into a solid. Pads 16, 20, when cool, may be ejected from the mold.

It may be seen from FIGS. 1 and 2 that system 10 also preferably includes a third sorbent pad 22, with second and third pads 20, 22 being dimensioned and configured as shown in FIGS. 1 and 2 to be in interference fit with one another to form a contact region indicated generally at 24 in FIG. 1. This placement of second pad 20 between first pad 16 and second pad 20, and in interference fit especially with the latter, causes second pad 20 to act as a conduit for the flow of ink between first and third pads 16, 22. Preferably, second and third pads 20, 22 are configured to present in mating contact with one another substantially conforming expanses 20*b*, 22*a* in contact region 24. Third pad 22 also preferably is formed of a material that is sorbently compatible with that of second pad 20, such that there is wicking action also therebetween.

On the other hand, in order better to promote substantial surface contact between second and third pads 20, 22, it has been found desirable to form one of the same out of a relatively hard material and the other out of a relatively soft material, thereby promoting substantial surface contact therebetween in contact region 24. In accordance with a preferred embodiment of the invention, third pad 22, including both mated sections thereof as will be described below, is formed of a layered sheet material an inner layer of which includes a pulp and fiber polyethylene and an outer layer of which includes a dry non-woven fabric. Preferably, three layers are provided in which the middle layer includes pulp and fiber polyethylene in a ratio of approximately 75:25 and in which two opposing outer layers between which the inner layer is sandwiched are each made of the cloth-like fabric. Preferably, pad 22 in a first section thereof is approximately 2.1 millimeters (mm) thick, producing a volume of approximately 3.4 $cm^3$, and in a second section thereof is approximately 4.2 mm thick, producing a volume of approximately 6.6 $cm^3$.

It may be seen from FIGS. 1 and 2 that third pad 22 preferably includes a substantial outer expanse 22*b* adhered to a wall region 26*a* of the printer's case 26. In one preferred embodiment, wall region 26*a* is non-planar, as shown, and in such case, third pad 22 may be seen to take the form of a foam sheet that is conformable to wall region 26*a*. By this means, the available void space available in ink-jet printer 12 is utilized optimally to greatly increase, e.g. to maximize, the spittoon's capacity. Those of skill in the art will appreciate that third pad 22 may assume any form that is compatible with optimally increasing its sorbent capacity.

FIGS. 1 and 2 illustrate that in accordance with the preferred embodiment of the invention, and in order to accommodate space constraints and avoid assembly difficulties with existing ink-jet printer configurations to which the present invention is retrofittable, third pad 22 is formed in two matable sections 28, 30 having confronting regions 28*a*, 30*a* that are interference fittable with one another to form third pad 22. This is largely due to the limited space presented in the existing printer product and of the availability of foam sheets in two different thicknesses compatible with such space. Also, the cost of tooling and injection molding a custom foam third pad is avoided by fittingly mating instead two foam pads or sheets of different thickness, e.g. preferably approximately 2.1 mm for section 28 and 4.2 mm for section 30.

Confronting regions 28*a*, 30*a* define a rabbet joint, indicated generally at 32 in FIG. 1, between one and another of matable sections 28, 30. Use of a rabbet joint as the form of joinder of sections 28, 30 to form third pad 22 has been found best to ensure wicking action by mating subsurfaces even if other subsurfaces are not mating due to slight location or orientation incompatibilities between the sections as installed on wall region 26*a* of printer's case 26. As also may be seen from FIGS. 1 and 2, matable sections 28, 30 are generally coplanar with one another, yet with the rabbet joint providing substantial surface area for promoting wicking of ink.

As may be seen from FIGS. 1 and 2, one of the matable sections, e.g. section 30; includes one finger defining rabbet joint 32 and the other of the matable sections, e.g. section 28, includes two fingers, wherein the one and the two fingers are dimensioned and configured to interlockingly confront one another to define the rabbet joint. Persons skilled in the art will appreciate that any suitable combination of n fingers on one of the two sections and n+1 fingers on the other is contemplated by, and thus is within the spirit and scope of, the invention. It is also within the spirit and scope of the invention to have an alternative form of joinder, e.g. simple planar abutment, between the two matable sections. It is also within the spirit and scope of the invention to have third sorbent pad 22 formed integrally, thus obviating the two matable sections and their rabbet joinder or formed from more than two matable sections.

In a most general sense, the invented system may be described as follows. System 10 includes a serial assemblage of sorbent pads, e.g. two or more of pads 16, 20, 22 as well perhaps as sections 28, 30 of the last, defining therebetween plural interface regions having plural characteristics including hardness and sorbency, as described above to include generally similar sorbency to promote wicking action and dissimilar hardnesses to maximize surface contact in the contact regions or interfaces such as that between second and third pads 20, 22. Such plural interface regions of course promote wicking action between the succession of pads. The assemblage of pads may be seen to take a serpentine path generally away from a region adjacent printhead 14 when it is in its service position, i.e. the position shown in FIG. 1.

It is the serpentine path and segmented structure of the invented spittoon system, as well as the interference fits and sheet configuration of the segmented and rabbet-joined third pad that renders the invention capable of lifetime spitted ink containment without leakage in a color portable ink-jet printer. The determined volume of the pads of the invention, which represents a tradeoff between minimizing volume due to space constraints and maximizing volume due to a lifetime spit requirement, is based on the realization that there typically is some ink evaporation between uses of the invented spittoon system. Empirical data confirms achievement of the important lifetime goal.

Industrial Applicability

It may be seen then that the invented spittoon system greatly increases the ink-accumulating capacity in an ink-jet printer having higher lifetime spitting requirements, e.g. a color portable ink-jet printer. The spittoon is inexpensively manufactured and easily installed or field retrofitted to an installed base of lower capacity portable color ink-jet printers. The configuration of plural sorbent pads in the invented system in its preferred embodiment is believed optimally to provide inter-pad wicking action that ensures reliable and smooth ink flow and accumulation generally safely and cleanly away from the printhead and other potentially damaged or contaminated surfaces.

While the present invention has been shown and described with reference to the foregoing preferred embodiment, it will be apparent to those skilled in the art that other changes in form and detail may be made therein without departing from the spirit and scope of the invention as defined in the appended claims.

I claim:

1. A high-capacity ink-containmnent system for use in an ink-jet printer to absorb ink spitted at the system from a printhead of the printer, the system comprising:

a serial assemblage of sorbent pads defining therebetween plural direct-contact interface regions, the sorbent pads having plural characteristics including hardness and sorbency, said plural direct-contact interface regions promoting wicking action between each pair of pads, wherein at least one of said plural direct-contact interface regions is maintained by spring-biasing one pad against another, said assemblage taking a serpentine path generally away from a region adjacent the printhead when the printhead is in a service position for spitting.

2. A high-capacity ink-containment system for use in an ink-jet printer to absorb ink spitted at the system from a printhead of the printer, the system comprising:

a first sorbent pad located adjacent the printhead for receiving and partly containing ink spitted from the printhead, said first pad including a protrusion extending in a first lateral direction;

a biasing spring operatively connected with said first sorbent pad for urging the first sorbent pad in said first direction; and a second sorbent pad laterally adjacent said first pad, said second pad having an upper region in direct contact with said protrusion of said first pad, with the contact being maintained by said biasing spring, said first pad and said second pad being formed of materials that are sorbently compatible such that there is wicking action therebetween.

3. The system of claim 2 which further comprises a third sorbent pad, said second pad and said third pad being dimensioned and configured in interference fit with one another to form a contact region, said second pad acting as a conduit for ink flowing between said first pad and said third pad.

4. The system of claim 3, wherein said second pad and said third pads are configured so that substantially conforming expanses matingly contact one another in said contact region.

5. The system of claim 4, wherein one of said second pad and said third pad is relatively hard and the other is relatively soft, thereby promoting substantial surface contact therebetween in said contact region.

6. The system of claim 5, wherein said first pad and said second pad are formed of a foam polyurethane.

7. The system of claim 5, wherein said third pad is formed of a layered sheet material an inner layer of which includes a pulp and fiber polyethylene and an outer layer of which includes a dry non-woven fabric.

8. The system of claim 5, wherein said first pad and said second pad are formed of a foam polyurethane material and wherein said third pad is formed of a layered sheet material an inner layer of which includes a pulp and fiber polyethylene and an outer layer of which includes a dry non-woven fabric.

9. The system of claim 5, wherein the printer includes a case, which case includes a wall region and wherein said third pad includes a substantial outer expanse, which expanse is adhered to the wall region of the case.

10. The system of claim 9, wherein the wall region of the case is non-planar and wherein said third pad takes the form of a foam sheet that is conformable to the wall region.

11. The system of claim 10, wherein said third pad is formed in at least two matable sections having confronting regions that are interference fittable with one another to form said third pad.

12. The system of claim 11, wherein said confronting regions define a rabbet joint between one of said matable sections and another of said matable sections.

13. The system of claim 12, wherein said one of said matable sections and said other of said matable sections are generally coplanar with one another, wherein said one of said matable sections includes one finger defining said rabbet joint and wherein said another of said matable sections includes two fingers, wherein said one and said two fingers interlockingly confront one of said matable sections another to define said rabbet joint.

* * * * *

UNITED STATES PATENT AND TRADEMARK OFFICE

CERTIFICATE OF CORRECTION

PATENT NO. : 5,617,125

DATED : APRIL 1, 1997

INVENTOR(S) : CHEE CHUAN CHEW

It is certified that error appears in the above-identified patent and that said Letters Patent is hereby corrected as shown below:

COLUMN 5, LINE 5, CHANGE "containment" to --containment--. IN LINE 13, DELETE THE WORD " direct".

Signed and Sealed this

Fourteenth Day of April, 1998

Bruce Lehman

*Attest:*

BRUCE LEHMAN

*Attesting Officer*

*Commissioner of Patents and Trademarks*